US006243887B1

(12) United States Patent
Palffy et al.

(10) Patent No.: US 6,243,887 B1
(45) Date of Patent: Jun. 12, 2001

(54) SEWER SYSTEM

(75) Inventors: Björn von Varfalva Palffy, Bromölla; Bengt Ohlsson, Kristianstad; Åke Nilsson, Sölvesborg, all of (SE)

(73) Assignee: EVAC International Oy, Helsinki (FI)

( * ) Notice: Subject to any disclaimer, the term of this patent is extended or adjusted under 35 U.S.C. 154(b) by 0 days.

(21) Appl. No.: 09/346,497

(22) Filed: Jun. 30, 1999

(30) Foreign Application Priority Data

Jul. 1, 1998 (FI) ..... 981512

(51) Int. Cl.[7] ..... E03D 11/00
(52) U.S. Cl. ..... 4/431; 4/434
(58) Field of Search ..... 4/431, 432, 433, 4/434, 435, 328, 209 R, 216

(56) References Cited

U.S. PATENT DOCUMENTS 3,651,524 3/1972 Bengtsson et al. .
4,159,550 * 7/1979 Tobin, Jr. ..... 4/421
5,369,811 * 12/1994 Serre ..... 4/431
5,487,193 * 1/1996 Hennessy ..... 4/328
5,539,938 7/1996 Tubbs .
5,813,061 9/1998 Törnqvist .

* cited by examiner

*Primary Examiner*—David J. Walczak
*Assistant Examiner*—Khoa D. Huynh
(74) *Attorney, Agent, or Firm*—John Smith-Hill; Smith-Hill and Bedell

(57) ABSTRACT

A sewer system includes a disposal system under atmospheric pressure, a sanitary unit provided with a water trap, and a branch sewer pipe connecting the sanitary unit to the disposal system. A vacuum generator is connected to the branch sewer pipe for generating underpressure in the branch sewer pipe. The vacuum generator is connected to the branch sewer pipe in a manner that allows waste to pass through the branch sewer pipe to the disposal system without obstruction by a temporary closure element.

18 Claims, 2 Drawing Sheets

SEWER SYSTEM

BACKGROUND OF THE INVENTION

This invention relates to a sewer system.

There are three basic types of known sewer systems. The most frequently used is the conventional gravitation sewer system having sewer pipes inclined downwards, in which the waste water flows by gravitation. In the pressure sewer system overpressure is used for transporting waste water through small-bore sewer pipes. The pressure system is not widely used, although it provides advantages such as small pipe dimensions and the possibility to lay pipes extending upward. In the vacuum sewer system, the pressure in the sewer pipe is reduced to about one half of atmospheric pressure and the pressure difference between the atmosphere and the reduced pressure in the sewer pipe is used for the transportation of sewage. The vacuum sewer system has achieved wide use in ships, aircraft and trains. In principal, it has the same advantages as the pressure sewer system. The main disadvantages of the vacuum sewer system are a relatively high cost and the fact that the sanitary units connected to the sewer must be separated from the sewer system by a normally closed discharge valve, which may cause flooding problems.

A fourth type of known sewer system is the low vacuum sewer system. The low vacuum sewer system is technically between the gravitation sewer system and the vacuum sewer system. In the case of the low vacuum sewer system, the toilet bowl may be connected to the sewer pipe through a trap, as in a gravity sewer system, or through a normally-closed discharge valve, as in the normal vacuum sewer system. For emptying a toilet bowl of a low vacuum system, a relatively low vacuum (about 0.1 to 0.4 bar below atmospheric) is generated in the sewer pipe. In some known systems of this type, a sluice device has been used as an interface between the space that is under vacuum, such as the sewer pipe, and a collecting container under atmospheric pressure. Such sluice devices have poor operational reliability because of leakage caused by deposits on the sealing surfaces of the sluice. Patent Publication SE 358196 describes a low vacuum system where the generation of vacuum requires a check valve in the sewer pipe. Practice has shown that such a check valve will not function satisfactorily in the long run. Furthermore, it is difficult to avoid dirt being drawn into the ducts that lead from the sewer pipe to the vacuum generator and which should normally contain only air. These difficulties seem to have been detrimental for marketing devices according to Patent Publication SE 358196. In general, known systems of this kind have had such a primitive or crude design that their operational reliability has suffered. They have been marketed substantially only as individual toilet units for summer cottages or the like.

SUMMARY OF THE INVENTION

The object of the invention is to develop a sewer system for buildings with several sanitary units, such as toilet bowls and urinals, in particular multi-family buildings such as apartment buildings, and hotels, hospitals or the like. The aim is to provide a simple and operationally reliable sewer system that neither requires the expensive technical solutions typical for vacuum sewer systems nor requires conventional sewer piping with large diameter downward sloping sewer pipes. On the contrary, the sewer pipes should have a small bore and it should be possible to have substantial distances laid horizontally and even to have some short sections laid upward.

Another object of the invention is to reduce the water consumption of the sanitary units to such an extent that it becomes economically profitable to separate the sanitary sewers containing so-called black water from other waste water sewers containing so-called gray water and subject the toilet waste to biological treatment. This requires that the amount of water at each toilet flush should not exceed 2 liters, preferably should not exceed 1 liter. Thereby the solids content of the toilet waste will be high, which makes it economically feasible to treat the toilet waste separately from other waste water.

A third object of the invention is to obtain an operationally reliable low cost suction system for emptying sanitary units, in which waste liquid drawn from a sanitary unit may freely flow from the vacuum area to an area under atmospheric pressure without passing check valves or other flow obstructing means.

A fourth object is that it should be easy to install a system according to the invention as a replacement for the normal gravitation sewer system in an existing building, or instead of a gravitation system during construction of a new building, whereby the discharge end of the building's internal sewer system should be directly connectable to the external sewer serving the building or to a special sewer network for toilet waste.

It is important for the application of the invention that each toilet bowl (or other sanitary unit) should have its own separate branch sewer pipe and its own separate vacuum generator. Vacuum (reduced pressure) is generated only intermittently, i.e. separately for each desired emptying of a sanitary unit. The vacuum generator, i.e. the device that generates vacuum, must allow free flow of the waste from the vacuum section of the sewer system to a section under atmospheric pressure. Suitable designs for this purpose are described below. The branch sewer pipes of each sanitary unit may be joined to a common pipe downstream of the vacuum generator of the sanitary unit.

For practical use it is important that smaller amounts of liquid may flow out from a toilet bowl without starting the normal emptying cycle based on vacuum generation. Thus, one should be able to empty a glass of water into a toilet bowl without any special measures.

Since vacuum is generated separately for each emptying operation, it is important that the volume within which the pressure has to be lowered is not too large. On the other hand, a certain minimum vacuum volume is needed in order to achieve a sufficient vacuum capacity to ensure a reliable emptying function. For providing a suitable volume it is recommended that the length of the sewer pipe between the trap and the device for generating vacuum is 2 to 50 m, preferably 5 to 15 m. Toilet emptying through suction requires relatively small-bore sewer pipes. The inner diameter of the length of sewer pipe between the outlet of the toilet bowl and the device for generating vacuum should therefore advantageously be at the most 65 mm, preferably at the most 55 mm.

An air driven ejector, preferably a so-called on-line ejector integral with the sewer pipe, has shown itself to be suitable in a system according to the invention. The working medium of such an ejector is advantageously supplied in the form of pressurized air or other pressurized gas. For achieving a sufficiently rapid vacuum generation in the case of the working medium being pressurized gas, the ejector should preferably be supplied with working medium for some seconds with a flow rate of 700 to 2000 l/min, preferably 1000 to 1500 l/min. The unit l/min relates to a volume that is calculated at a temperature of 20° C. and atmospheric pressure. The dynamic pressure in the supply of working medium to the ejector is advantageously 7 to 40 kPa, preferably 10 to 30 kPa.

An on-line ejector of the type referred to is useful because toilet waste can easily pass through the ejector. An ejector of a suitable type is described in U.S. Pat. No. 5,813,061, the disclosure of which is hereby incorporated by reference herein. This ejector is intended for generating a considerably stronger vacuum (lower absolute pressure) than is needed in a system according to the invention, but a modification of the performance of the ejector can be made by reducing the flow of working medium. The best operational reliability is usually obtained by connecting the ejector at an angle to the sewer pipe, so that the segments of the sewer pipe immediately before and after the ejector form an angle of at least 120°, preferably at least 135°.

For the same reasons as described in U.S. Pat. No. 5,813,061, it is recommended that there is a safety device, e.g. a relief valve, upstream of the on-line ejector. This is for preventing the pressure of the working medium of the ejector from being transmitted in a back-flow manner to the sanitary unit, in case of flow disturbances downstream of the ejector. The safety device may also include a pressure sensor that rapidly shuts off the flow of working medium to the ejector if the pressure in the sewer upstream of the ejector exceeds a given threshold value.

The ejector may be supplied with working medium by a blower or the like installed as a ventilator of, for example, the space where the sanitary unit connected to the sewer is situated. The exhaust air from the ventilator may then be used as the working medium in the ejector, provided that the ventilator is of sufficiently high power. Another suitable source of the ejector's working medium is exhaust air from a central vacuum cleaning system, if such a system is available.

If one does not want to use an on-line ejector or another vacuum generator allowing through-flow, the vacuum generator may be arranged off-line, e.g. in a branch line connected to the sewer pipe. In this case, it is desirable to shut off the vacuum generator at an early stage of the toilet emptying process in order to prevent waste liquid, moisture or dirt being drawn into the vacuum generator. Then it might be necessary to maintain vacuum in the branch sewer pipe after the vacuum generator has been shut off. Inertia of the vacuum generator prevents the vacuum generator from stopping immediately its power supply is cut off, and this action maintains vacuum for a short period. In addition, vacuum may be maintained by designing the sewer as a stand pipe having its lower end in a trap of a sufficiently large volume. When vacuum is generated in the sewer, some of the liquid in the trap is drawn up into the stand pipe to form there a water column. When the vacuum generator is shut off, the water column falls and maintains vacuum in the sewer pipe. The volume ratio of the water column and the branch sewer pipe influence the operation. Since the vacuum in a system according to the invention is about 3 to 20% of the atmospheric pressure (the absolute pressure thus being 97 to 80% of the atmospheric pressure), the vertical dimension of the stand pipe does not have to be more than about 2 m. For most practical applications a stand pipe height of about 1 m is sufficient.

By dimensioning the toilet's trap and rinse water supply so that the amount of rinse water used at each toilet emptying does not exceed 2 liters, or preferably is around 1 liter, the advantage is achieved that the amount of liquid in the toilet waste is so small that separating the toilet waste from other waste water becomes profitable.

BRIEF DESCRIPTION OF THE DRAWINGS

In the following, the invention will be described more in detail with reference to the accompanying schematic drawings, in which.

DETAILED DESCRIPTION

Figure 1:
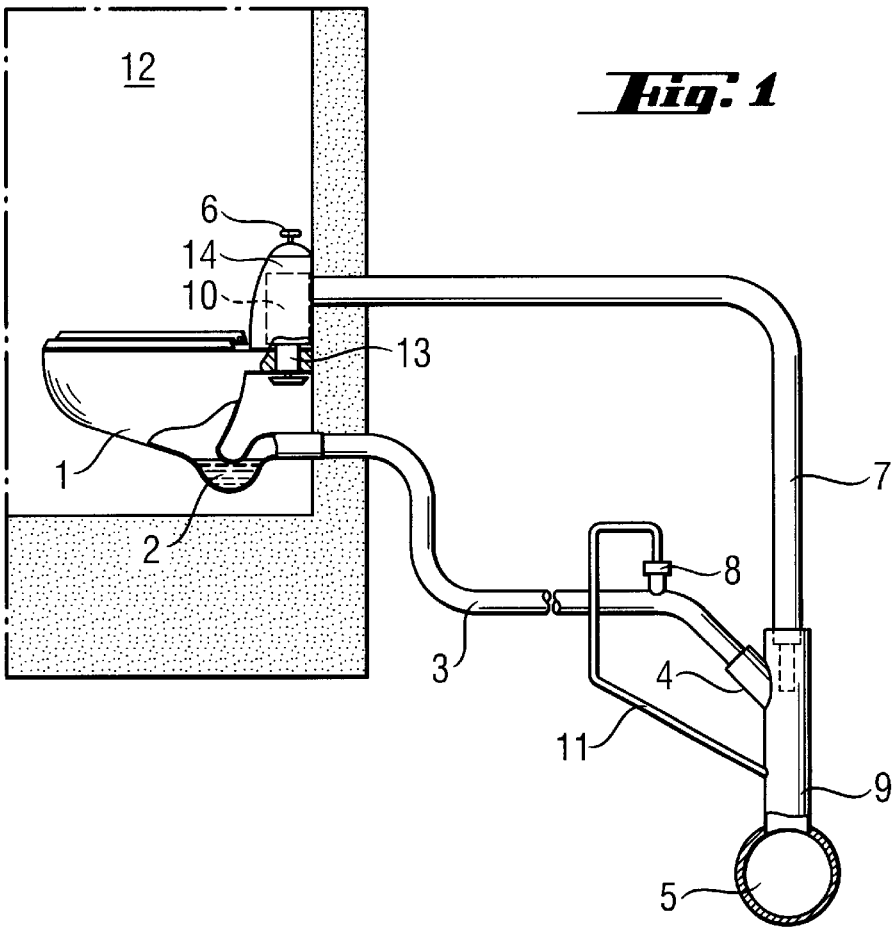
FIG. 1 shows a single toilet bowl of a suction sewer system according to the invention.
Figure 2:
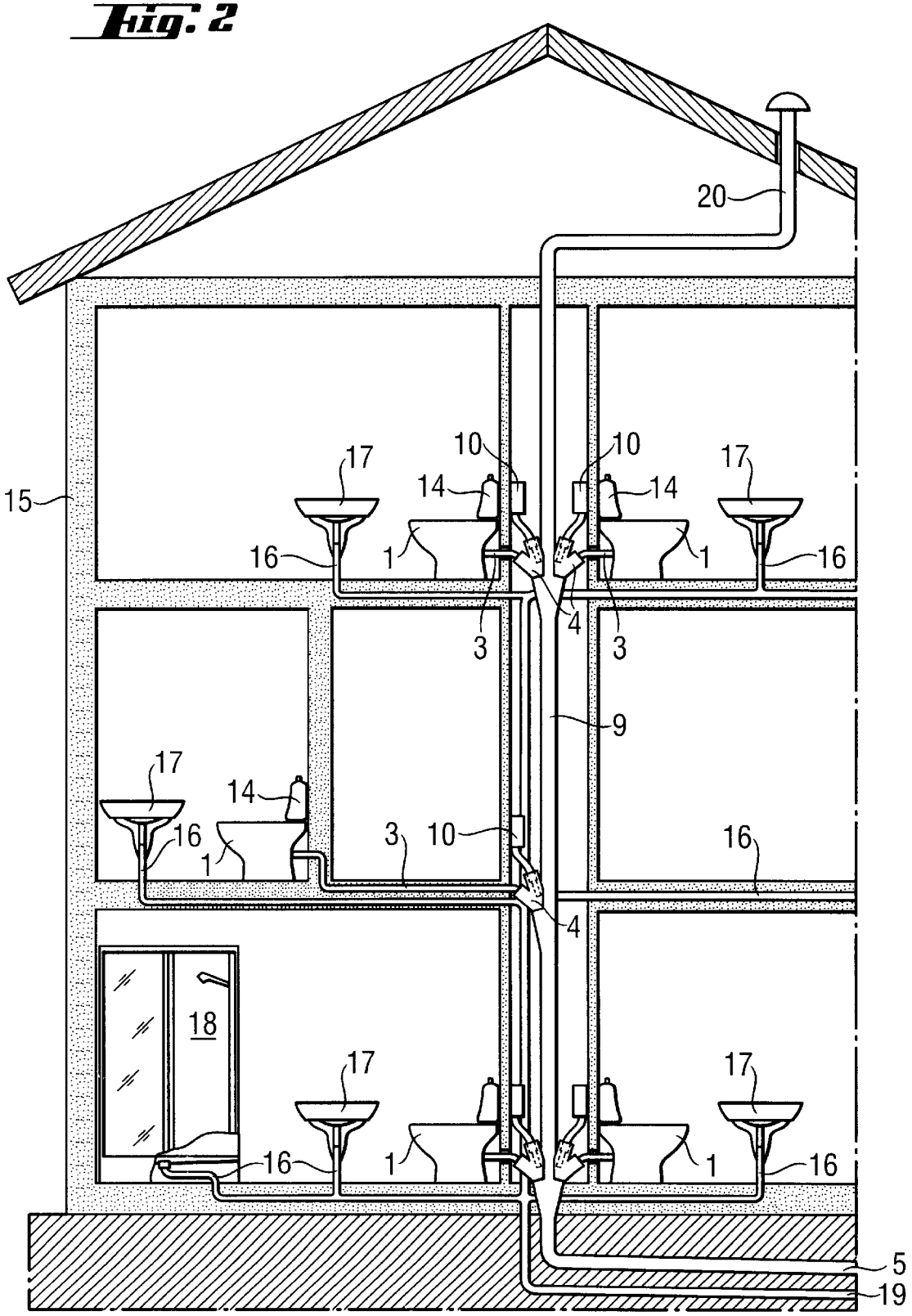
FIG. 2 shows a building with a number of toilet bowls according to the invention.

In the drawings, 1 indicates a toilet bowl with a trap 2 at its outlet duct. A branch sewer pipe 3 with an inner diameter of about 50 mm is connected to the toilet bowl 1. The sewer pipe 3 leads to a vacuum generator. In the case of FIGS. 1 and 2, the vacuum generator is an air driven ejector 4. When air of suitable pressure is supplied by a blower 10 through a feed pipe 7 to the ejector 4, the ejector rapidly generates a vacuum of about 10% in the pipe 3 (the absolute pressure in the pipe thus being 90% of atmospheric pressure). The pressure of the ambient air in the toilet bowl then forces the liquid in the trap 2 and waste and water in the toilet bowl rapidly into the sewer pipe 3.

As long as the air flow in the feed pipe 7 is maintained, the ejector 4 continues to generate vacuum and after some seconds all waste from the toilet bowl 1 will have reached the ejector. The waste passes through the ejector and flows into a second part 9 of the sewer pipe downstream of the ejector 4. Because the working medium of the ejector is exhausted into the sewer pipe downstream of the ejector, the pressure downstream of the ejector is somewhat above atmospheric pressure. This higher pressure gives the waste that has passed the ejector 4 an extra push forward in the pipe 9 and it flows out into a municipal sewer 5 or other collecting duct which typically serves several buildings. The pipe 9 preferably has a somewhat larger bore than the pipe 3, the cross-section area of the bore of the pipe 9 being 70 to 100% larger than that of the pipe 3. The length of the pipe 3 between the toilet bowl 1 and the ejector 4 is about 6 m. The angle between the end of the pipe 3 and the pipe 9 is about 150°, which is an advantageous value for ejectors of the type shown.

Upstream of the ejector 4, at a distance of about 1 m or less therefrom, there is a safety device 8, such as a sensitive safety valve, or alternatively a device that stops the blower 10, should the pressure in pipe 3 rise above a threshold value. The safety device 8 may also have both these functions at the same time. If clogging or the like should create a substantial flow obstruction in the pipe 9, the suction effect of the ejector 4 ceases and pressure from the working medium of the ejector propagates as a back-flow into the branch sewer pipe 3. This could result in foul-smelling air and water being blown into the toilet bowl 1 through the trap 2. The object of the safety device 8 is to eliminate such incidents.

The blower is able to supply the ejector 4 with pressurized air for some seconds at a flow rate of 700–2,000 l/min, preferably 7–40 kPa, preferably 10–30 kPa.

The blower 10 also functions as a ventilator for the room 12 in which the toilet bowl is located. The blower 10 is connected to a ventilating pipe 13 which draws air from the room 12. Alternatively, the blower may be the blower of a central vacuum cleaning system or the like. The blower may even be placed in or behind the wall of the room 12.

The emptying of the toilet bowl 1 is started by operating a flush button 6 in the room 12. Then the blower 10 starts and the ejector 4 generates vacuum in the pipe 3. Atmospheric pressure in the toilet bowl forces the contents of the toilet bowl 1 into the pipe 3. Simultaneously with activating the blower 10, a rinse water valve (not shown) is opened and rinse water is supplied from the rinse water container 14 to rinse the inner surface of the toilet bowl. The rinse water valve stays open at least during the initial phase of emptying the toilet bowl 1. Upon closing the rinse water valve, the blower 6 continues to operate the ejector 4 for a sufficient time for all the waste from the toilet bowl to pass the ejector 4. The time is controlled by an adjustable time relay (not shown). Upon stopping the blower 10 the rinse valve again opens for filling the water trap 2 with clean water.

If the toilet bowl 1 is provided with a rinse water container 14 of standard type, which has a much larger volume than is needed to contain the rinse water for a toilet bowl of a system according to the invention, some of the space in the rinse water container may, as shown in FIG. 1, be used for housing the blower 10 for driving the ejector 4. Thereby a simpler installation is obtained with all necessary parts in or near the toilet bowl.

FIG. 2 shows a building 15 with a total of five toilet bowls 1 on three different floors. Each toilet bowl 1 has its own ejector 4 with a blower 10, which as described with reference to FIG. 1 generates vacuum in the toilet bowl's branch sewer pipe 3. The sewer pipes 3 from the toilet bowls 1 are joined to a common vertical sewer pipe 9, which is connected to a main sewer line 5 for separate treatment of the toilet waste. Other sanitary units in the house such as wash basins 17 and shower stalls 18 have their own branch sewer pipes 16, which are connected to a municipal sewer pipe 19. The sewer pipe 9 is connected at its top to a ventilation pipe 20, which opens above the roof of the building 15. The sewer pipes 16 can be joined to the same ventilation pipe or have their own ventilation pipe (not shown).

In the embodiment shown in FIG. 2 the safety device 8 shown in FIG. 1 is not needed. Since the vertical sewer pipe 9 is connected to the ventilation pipe 20 no overpressure can develop downstream of the ejector 4. Thus, there is no risk of pressure shocks propagating towards the toilet bowls 1.

Figure 3:
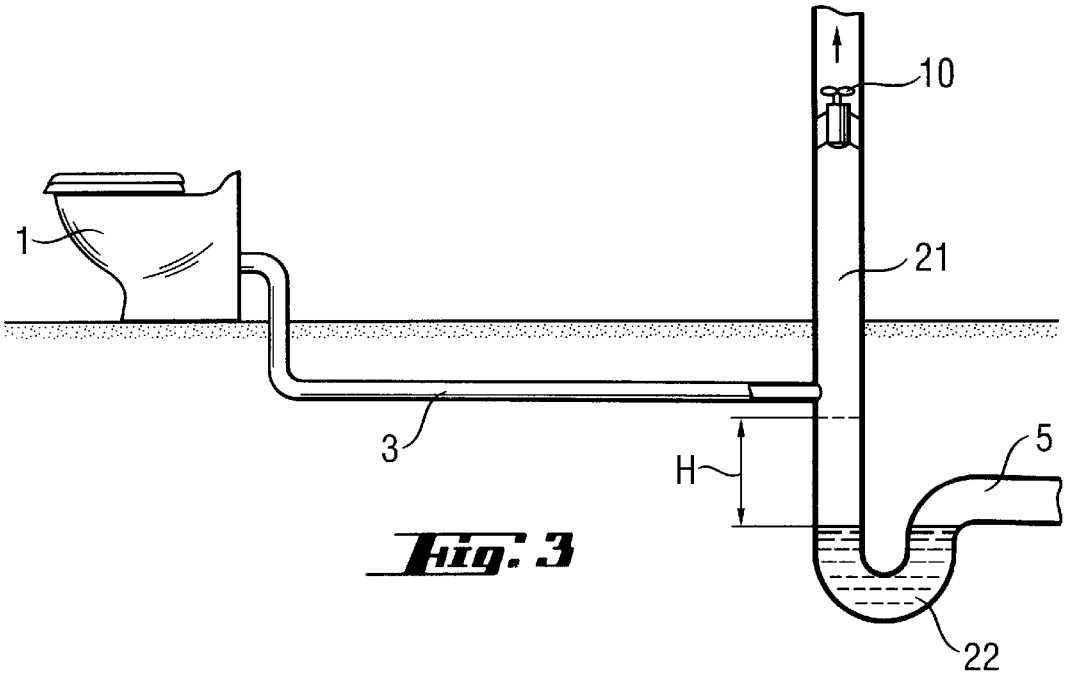
FIG. 3 shows a vacuum sewer system having a single toilet bowl and in which the vacuum generator is provided with a stand pipe.

The location at which the ejector 4 shown in FIG. 1 generates vacuum is in the flow path from the toilet bowl 1 to the sewer pipe 5. FIG. 3 shows vacuum generation off-line, i.e. out of the flow path from the toilet bowl 1 to the sewer pipe 5. The toilet bowl 1, which is of the same configuration as the toilet bowls shown in FIGS. 1 and 2, is connected to a branch sewer pipe 3 in the same manner as in FIG. 1 and FIG. 2. In the case of FIG. 3, the vacuum generator is an electric blower 10 in a pipe 21 branched off from the sewer pipe 3. The pipe 21 may be connected to a duct that corresponds to the ventilation pipe 20 in FIG. 2. The sewer pipe 5 is under atmospheric pressure and the vacuum generated by the blower 10 lifts the liquid of a large trap 22 arranged upstream of the sewer pipe 5. The liquid is lifted a distance H, which, at a vacuum of 10% is about 1 m. When the blower 10 is shut off, the water column in the pipe 21 falls, thus maintaining the necessary vacuum in the pipe 3 for the time needed for emptying the toilet 1 and for transporting the waste to the lower part of the pipe 21. Further, inertia of the blower 10 maintains vacuum in the pipe 3 for a short time after the blower is shut off.

It will be seen from the foregoing that in each case the path from the toilet bowl to the sewer pipe 5 is not obstructed by a temporary closure element, such as the discharge valve used in the conventional vacuum sewer system.

The invention is not limited to the embodiment disclosed, but several modifications thereof are feasible, including variations that have features equivalent to, but not literally within the meaning of, features in any of the ensuing claims. Reciting an element in the claims in the singular is not intended to limit the scope of the claims such as to exclude multiple such elements.

What is claimed is:

1. A sewer system including a disposal system under atmospheric pressure, a sanitary unit provided with a trap means for allowing liquid to flow freely from the sanitary unit through the trap means and preventing flow of gas into the sanitary unit through the trap means, a branch sewer pipe connected at one end to the trap and at an opposite end to the disposal system and forming a flow path between the sanitary unit and the disposal system, and an air driven vacuum generator connected to the branch sewer pipe at said opposite end thereof for generating underpressure in the branch sewer pipe, the vacuum generator allowing waste to flow freely out of the sanitary unit, along the flow path and past the vacuum generator to the disposal system.

2. A system according to claim 1, wherein the branch sewer pipe has an interior diameter which is at the most 65 mm, preferably at the most 55 mm.

3. A system according to claim 1, wherein the branch sewer pipe is of a length between 2 and 50 m, preferably between 5 and 15 m, from the water trap to the vacuum generator.

4. A system according to claim 1, wherein the vacuum generator is an air driven ejector having a feed system for supplying the ejector with pressurized air at the most for some seconds at a flow rate of 700 to 2000 l/min, preferably 1000 to 1500 l/min.

5. A system according to claim 1, wherein the vacuum generator is an air driven ejector having a feed system for supplying the ejector with pressurized air at the most for some seconds at a flow rate of 700 to 2000 l/min, preferably 1000 to 1500 l/min, and at a dynamic pressure of 7 to 40 kPa, preferably 10 to 30 kPa.

6. A system according to claim 1, wherein the vacuum generator is an on-line air driven ejector having a suction pipe and a discharge pipe and integral with the branch sewer pipe so that the suction pipe and the discharge pipe form respective parts of the branch sewer pipe, thereby dividing the sewer pipe into an upstream portion and a downstream portion, and wherein the upstream and downstream portions of the branch sewer pipe are connected to the ejector at an angle, so that the sewer pipe immediately before and after the ejector forms an angle of at least 120°, preferably at least 135°.

7. A system according to claim 6, comprising a safety device between the water trap and the ejector for preventing formation of overpressure upstream of the ejector.

8. A system according to claim 1, wherein the vacuum generator is an air driven ejector and the system further comprises a blower for supplying air to the ejector, the blower having a suction side arranged to draw air from a space for ventilating that space.

9. A system according to claim 8, wherein the suction side of the blower is arranged to draw air from the space where the sanitary unit is situated.

10. A system according to claim 1, wherein the sanitary unit is a toilet bowl, and the system includes a rinse water supply for rinsing the interior of the toilet bowl in connection with each emptying of the toilet bowl, and the water trap and the rinse water supply are so dimensioned that no more than 2 liters, preferably no more than 1 liter, of water follow the toilet waste into the branch sewer pipe for each emptying of the toilet.

11. A sewer system including a disposal system under atmospheric pressure, a sanitary unit provided with a trap means for allowing liquid to flow freely from the sanitary unit through the trap means and preventing flow of gas into the sanitary unit through the trap means, a branch sewer pipe connected at one end to the trap and at an opposite end to the disposal system and forming a flow path between the sanitary unit and the disposal system, and an air driven vacuum generator connected to the branch sewer pipe at said opposite end thereof for generating underpressure in the branch sewer pipe, the vacuum generator allowing waste to flow freely out of the sanitary unit, along the flow path and through the vacuum generator to the disposal system.

12. A system according to claim 11, wherein the vacuum generator is an air driven ejector.

13. A system according to claim 11, wherein the vacuum generator is an on-line air driven ejector having a suction pipe and a discharge pipe and integral with the branch sewer pipe so that the suction pipe and the discharge pipe form respective parts of the branch sewer pipe, thereby dividing the branch sewer pipe into an upstream portion and a downstream portion.

14. A system according to claim 13, comprising a safety device between the water trap and the ejector for preventing formation of overpressure upstream of the ejector.

15. A system according to claim 11, wherein the vacuum generator is an air driven ejector and the system further comprises a blower for supplying air to the ejector, the blower having a suction side arranged to draw air from a space for ventilating that space.

16. A system according to claim 15, wherein the suction side of the blower is arranged to draw air from the space where the sanitary unit is situated.

17. A sewer system including a disposal system under atmospheric pressure, a sanitary unit provided with a water trap, a branch sewer pipe connecting the sanitary unit to the disposal system, and a vacuum generator connected to the branch sewer pipe for generating underpressure in the branch sewer pipe, and wherein the vacuum generator is an air driven ejector connected to the branch sewer pipe in a manner that allows waste to pass through the branch sewer pipe to the disposal system without obstruction by a temporary closure element and the system further comprises a blower for supplying air to the ejector, the blower having a suction side arranged to draw air from a space for ventilating that space.

18. A system according to claim 17, wherein the suction side of the blower is arranged to draw air from the space where the sanitary unit is situated.

* * * * *